United States Patent [19]

Kovacs et al.

[11] Patent Number: 5,009,853

[45] Date of Patent: Apr. 23, 1991

[54] FLUID CATALYTIC CRACKING REGENERATION WITH REDUCTION OF NITROGEN OXIDE

[75] Inventors: Richard C. Kovacs, Mantua; Frederick J. Krambeck, Cherry Hill; Michael S. Sarli, Haddonfield, all of N.J.

[73] Assignee: Mobil Oil Corporation, Fairfax, Va.

[21] Appl. No.: 512,637

[22] Filed: Apr. 18, 1990

Related U.S. Application Data

[60] Continuation of Ser. No. 285,574, Dec. 16, 1988, abandoned, which is a division of Ser. No. 71,247, Jul. 9, 1987, abandoned.

[51] Int. Cl.[5] ..... F27B 15/12; F27B 15/08

[52] U.S. Cl. ..... 422/144; 422/145; 422/147

[58] Field of Search ..... 422/144, 145, 147; 208/164; 502/42, 43

[56] References Cited

U.S. PATENT DOCUMENTS

| | | | |
|---|---|---|---|
| Re. 31,046 | 10/1982 | Lombana et al. | 110/187 |
| 3,785,782 | 1/1974 | Cartmell | 422/144 |
| 3,893,812 | 7/1975 | Conner et al. | 208/164 |
| 3,926,778 | 12/1975 | Owen et al. | 208/74 |
| 3,990,992 | 11/1976 | McKinney | 252/417 |
| 4,035,284 | 7/1977 | Gross et al. | 208/120 |
| 4,051,069 | 9/1977 | Bunn, Jr. et al. | 292/417 |
| 4,211,636 | 7/1980 | Gross et al. | 208/164 |
| 4,274,942 | 6/1981 | Bartholic et al. | 208/113 |
| 4,331,533 | 5/1982 | Dean et al. | 208/113 |
| 4,354,957 | 10/1982 | Swindell et al. | 208/164 |
| 4,436,613 | 3/1984 | Sayles et al. | 502/42 |
| 4,584,090 | 4/1986 | Farnsworth | 208/80 |

*Primary Examiner*—Robert J. Warden
*Assistant Examiner*—D. John Griffith, Jr.
*Attorney, Agent, or Firm*—Alexander J. McKillop; Charles J. Speciale; Malcolm D. Keen

[57] ABSTRACT

An FCC catalyst regeneration technique in which the catalyst is regenerated in a dense bed regenerator. Regeneration effluent gases are collected from different parts of the regenerator vessel in a common collection zone and passed through the catalyst separation cyclones from the common collection zone. The cyclones may be arranged with their inlet horns adjacent one another in the common collection zone or a cyclone inlet manifold with a common inlet may be connected to the cyclone inlets. The inlet port to the manifold may be extended to form an elongated vertical duct through which regeneration effluent gases and entrained catalyst pass from the dilute phase of the dense bed to the cyclone so that mixing of the effluent gases is promoted to ensure combustion in residual quantities of oxygen present in the effluent gases before the gases enter the cyclones. Improved operating flexibility is obtained together with a reduced likelihood of cyclone damage as a result of localized high temperature excursions. In addition, the $NO_x$ level of the regenerator stack gases is reduced.

8 Claims, 8 Drawing Sheets

FLUID CATALYTIC CRACKING REGENERATION WITH REDUCTION OF NITROGEN OXIDE

This is a continuation of copending application Ser. No. 285,574, filed on Dec. 16, 1988.

Which is a divisional of copending application Ser. No. 071,247, filed on July 9, 1987.

FIELD OF THE INVENTION

This invention relates to fluid catalytic cracking and more particularly to the regeneration portion of the fluid catalytic cracking cycle.

BACKGROUND OF THE INVENTION

The fluid catalytic cracking (FCC) process has become well-established in the petroleum refining industry for converting higher boiling petroleum fractions into lower boiling products, especially gasoline. In fact, the fluid catalytic cracking process has become the preeminent cracking process in the industry for this purpose, providing approximately 95% of the total catalytic cracking capacity in the United States.

In the fluid catalytic process, a finely divided solid cracking catalyst is used to promote the cracking reactions which take place in the feed. The catalyst is used in a very finely divided form, typically with a particle size range of 20–300 microns, with an average of about 60–75 microns, in which it can be handled like a fluid (hence the designation FCC) and in this form it is circulated in a closed cycle between a cracking zone and a separate regeneration zone. In the cracking zone, hot catalyst is brought into contact with the feed so as to effect the desired cracking reactions after which the catalyst is separated from the cracking products which are removed from the cracking reactor to the associated fractionation equipment for separation and further processing. During the cracking reaction, coke is deposited on the catalyst and this deposit of coke deactivates the catalyst so that it needs to be regenerated before it can be reused. Fortunately, the coke deposit can be made to serve a useful purpose. Cracking is an endothermic reaction which requires the input of significant amounts of heat in order to carry the cracking reactions to completion. Although, in principle, heat could be supplied by raising the temperature of the hydrocarbon feed prior to contact with the catalyst, this would result in a significant degree of unselective thermal cracking so that very little control could be effected over the product distribution and, in addition, considerable coking would occur in the furnace and other equipment used for heating and conveying the feed to the cracker. For this reason, it is generally preferred to supply the heat to the cracking reaction by means of the catalyst although the feed may be preheated to a certain degree in order to maintain an appropriate heat balance in the cycle. Heat for the process is supplied by the regeneration step in the cycle in which the spent catalyst is subjected to oxidative regeneration so as to remove the carbon deposits accummulated during the cracking step and to supply heat to the catalyst by the exothermic oxidation reactions which take place during regeneration.

The regeneration takes place in a separate regenerator vessel in which the catalyst is maintained in a fluidized bed into which an oxygen-containing gas, usually air, is admitted through a distribution grid which is designed to provide efficient mixing of air with the spent, coked catalyst. During the regeneration step, the coke on the spent catalyst is oxidized and the heat from the oxidation is transferred to the catalyst to raise its temperature to the requisite level for continuing the cracking reactions. The hot, freshly-regenerated catalyst is then returned to the cracking zone for contact with further feed together with any recycle. Thus, the catalyst circulates continuously in a closed cycle between the cracking zone and the regenerating zone with heat for the endothermic cracking reactions being supplied in the regenerator by oxidative removal of the coke deposits which are laid down during the cracking portion of the cycle. In order to maintain the desired level of catalyst activity and selectivity, a portion of the circulating inventory of catalyst may be withdrawn intermittently or continuously with fresh, make-up catalyst being added to compensate for the withdrawn catalyst and the catalyst losses which occur through attrition and loss of catalyst from the system.

A further description of the catalytic cracking process and the role of regeneration may be found in the monograph, "Fluid Catalytic Cracking With Zeolite Catalysts", Venuto and Habib, Marcel Dekker, New York, 1978. Reference is particularly made to pages 16–18, describing the operation of the regenerator and the flue gas circuit.

The amorphous cracking catalysts which were initially used in the FCC process were characteristically low activity catalysts which gave a relatively low hydrocarbon conversion with a relatively low carbon lay-down on the catalyst. Because the carbon provides the heat for the regeneration process, the carbon lay-down is a measure of the heat which can be produced during the regeneration and, consequently, of the regeneration temperature. Thus, the use of amorphous catalysts implied the use of relatively low regeneration temperatures.

The development of synthetic zeolite cracking catalysts, especially the zeolite cracking catalysts represented mainly by the synthetic faujasite zeolite Y, typically in the form of rare earth exchanged zeolite Y (REY) or ultrastable Y (USY) represented a considerable advance in the technology of the FCC process, but it was accompanied by its own problems. In contrast to the older, amorphous cracking catalysts which they rapidly supplanted, the zeolite catalysts were characterised as relatively high conversion catalysts which produced a relatively high carbon lay-down on the catalyst. The relatively higher carbon lay-down resulted in higher regenerator temperatures and higher burning rates both for the carbon on the catalyst and for the carbon monoxide produced during the combustion process. With the production of greater heat in the regenerator, the catalyst circulation rate was reduced since the process as a whole needs to remain in a heat balanced condition and this was desirable since it enabled the catalyst make-up rate to be reduced, a valuable economic factor.

The zeolite cracking catalysts are, in general terms, more sensitive to residual carbon than the amorphous catalysts, particularly with respect to selectivity. This sensitivity, coupled with the fact that operation under high temperature regeneration conditions was desirable for other reasons, as indicated above, provided an incentive for higher regenerator temperatures and lower residual carbon levels on the regenerated catalyst. To achieve this, it became necessary to carry the combustion of the carbon in the regenerator through to the final oxidation product, carbon dioxide, rather than to stop at the intermediate stage of carbon monoxide with the highly exothermic combustion of this product taking place in an external CO boiler. With operation in the full CO burning mode, the residual carbon levels on the catalyst fell to about 0.25 wt. percent or lower as compared to about 0.5 wt. percent with the amorphous oxide and clay catalysts operating in a non-CO burning regenerator. According to present standards a residual coke content of 0.1% or less coke on the regenerated catalyst is considered to represent a "clean burned" catalyst with higher coke contents being representative of only partial regeneration.

Two types of FCC regenerators are now in general use. The first type is the high-inventory, dense bed type regenerator in which the catalyst enters the regenerator from the reactor and combustion is induced in a dense bed of catalyst by means of combustion air which is injected from below. Typical regenerators of this type are shown, for example, in 1984 *Refining Process Handbook*, "Hydrocarbon Processing", Sept., 1984, pp. 108–109, Venuto and Habib, op cit p. 17 and U.S. Pat. Nos. 4,072,600 and 4,300,997. In regenerators of this type, a dense bed of catalyst is fluidized by the injected air with a dilute phase of catalyst above the dense bed. In one variant of this type of regenerator, the spent catalyst from the reactor is introduced tangentially into the dense bed of catalyst to impart a swirling motion to the dense bed so that the catalyst moves in an approximately circular path during regeneration until it is removed through a discharge port below the top of the dense bed. In order to ensure a sufficiently long average residence time in the regenerator, the discharge port is positioned around the vertical axis of the regenerator from the catalyst inlet port. An angular separation of 270° measured in the direction of swirl is typical. The relatively high volume of catalyst in the regenerator ensures that the average residence is longer than that required to make one circuit of the regenerator so that some of the hot, regenerated catalyst will continue in the swirling bed to mingle with the spent catalyst from the reactor so as to promote the combustion of the coke deposits on the newly added spent catalyst.

The gases passing through and rising from the dense bed carry with them a portion of the catalyst from the dense bed and this produces a dilute phase of suspended catalyst above the dense bed. The dilute phase passes to cyclone separators at the top of the regenerator vessel where the catalyst is removed, to be returned to the dense bed through diplegs attached to the cyclones. The effluent gases from the regenerator are then discharged from the unit.

When this type regenerator is operated in the CO combustion mode, a CO combustion promoter such as platinum or another noble metal is conventionally provided in the catalyst, either as a component of the catalyst itself or, more usually, as an additive. The use of CO combustion promoters is described in U.S. Pat. No. 4,072,600. The effluent gases contain relatively higher amounts of carbon dioxide so that the CO boiler no longer serves any purpose, although waste heat recuperators are typically provided to recover the sensible heat of the regenerator effluent gases. With essentially complete combustion of the carbon monoxide in the regenerator, substantially all of the heat which is potentially recoverable from the coke deposited on the catalyst is returned to the catalyst with the result that the unit operates in a thermally balanced mode with minimal feed preheat requirements, as compared to the earlier mode of operation in which significant quantities of heat were lost in the downstream CO boiler.

An associated development in the technology of regeneration is represented in the low-inventory type regenerator in which combustion of the coke on the spent catalyst is initiated and carried through to a significant degree in a dense bed of relatively small volume, after which the catalyst together with effluent gases from the dense bed is passed up a riser in which combustion of the carbon monoxide takes place with a resultant, highly efficient transfer of heat from the CO oxidation reaction to the catalyst in the riser. The presence of the catalyst in the region where the CO oxidation takes place prevents damage to the regenerator equipment because the catalyst acts as a heat sink for the CO oxidation reaction and, in this way, the twin objectives of obtaining a clean-burned catalyst and of ensuring continued structural integrity of the regenerator equipment are assured. In this type of regenerator, recycle of the hot regenerated catalyst from the top of the riser to the dense bed is provided in order to provide an adequately high temperature in the dense bed for rapid combustion of the coke on the spent catalyst. Regenerators of this type are described in U.S. Pat. No. 3,926,778 and high-efficiency, low-inventory regenerator type units of this type have enjoyed a significant commercial success. A regenerator of this type is also shown in U.S. Pat. No. 4,072,600 (FIG. 4), since the use of a CO oxidation promoter is desirable for this type of regenerator as with the more conventional, high-inventory regenerator.

As with the use of zeolite cracking catalysts, however, the advantages of CO burning in the regenerator have not been bought without cost. As pointed out above, the combustion of carbon monoxide to carbon dioxide is a strongly exothermic reaction and in the high-inventory, dense type bed regenerator the release of heat from this reaction may cause significant problems if it takes place above the dense bed of catalyst. In the dilute catalyst phase above the dense bed, some catalyst is present to act as a heat sink for the released heat but even then, insufficient catalyst may be present so that the heat will be carried off in the effluent gases through the cyclones resulting in an increase in cyclone temperature, possibly to undesirably high values. If the CO oxidation front moves up to the cyclone inlets, equipment failure is highly likely as a result of the extreme exotherms in this region.

Regenerator operation in the CO oxidation mode has therefore been concerned with mitigating the effects of "afterburning", the term commonly used to designate oxidation of the carbon monoxide above the dense fluid bed. The use of combustion promoters produces a significant improvement because the promoters increase the degree of oxidation which takes place in the dense bed. However, there are limits on the amounts of promoter which may be used because high promoter levels are associated with high levels of nitrogen oxides ($NO_x$) in the regenerator effluent gases as discussed in U.S. Pat. No. 4,235,704. Other improvements have been achieved by changes in reactor construction to improve the contact between the catalyst and the regeneration air, for example, as described in U.S. Pat. Nos. 4,118,448, 4,118,337, 4,387,043, 3,990,992 and 4,219,442.

Another problem frequently encountered, especially in large regenerators is that of poor air/catalyst contacting efficiency. This may be occasioned by bubble formation in the bed so that the gas bypasses the catalyst or uneven carbon distribution in the dense bed as a result of imperfect solids mixing. This too manifests itself by afterburning in the dilute phase where the absence of a heat sink leads to localized dilute phase hot spots and possibly to damage to the cyclones. If this problem is of a continuing nature with any unit and catalyst, it may become necessary to limit the severity of the cracking operation in order that the regenerator can be safely operated within acceptable limits. Thus, the refiner may find his cracking operation undesirably restricted by limits on the regenerator operation.

Another problem which is encountered with the regenerator operating with noble metal-promoted complete carbon monoxide combustion is that excessive amounts of nitrogen oxides ($NO_x$) may be produced in the regenerator. The use of certain additives such as palladium and ruthenium for promoting CO combustion without causing the formation of excessive amounts of nitrogen oxides is described in U.S. Pat. Nos. 4,300,947 and 4,350,615.

Studies of fluidized bed combustion of coal have shown that staged combustion is an effective way of reducing $NO_x$ emissions if the lower part of the combustor is operated to achieve a region which is rich in gaseous, oxidizable carbon (CO and coal volatiles) and relatively depleted in oxygen. This atmosphere reduces $NO_x$ species to molecular nitrogen, ammonia and other nitrogenous compounds. Secondary air is introduced at a higher level in the combustor to complete oxidation of the oxidizable, gaseous carbon content but without causing oxidation of the reduced $NO_x$ species. Reference is made to Bergsmeyer, F. "Abatement of $NO_x$ from Coal Combustion. Chemical background and Present State of Technical Development" Ind. Eng. Chem. Process Des. Dev. 24 (1), 1985. These concepts have been extended to the staged FCC catalyst regeneration as described in U.S. Pat. Nos. 4,309,309 and 4,313,848 where multiple air distributors in the dense bed with external recirculation of regenerated catalyst are employed to achieve staged combustion. Whatever the merits of this proposal, it is undesirable from the point of view of mechanical complications as well as of equipment capital cost.

SUMMARY OF THE INVENTION

We have now found that the problems associated with operating a conventional, dense bed FCC regenerator in the full CO combustion mode may be alleviated by a modification of the conventional arrangement for the inlets of the regenerator cyclones. By locating the inlets to the cyclones in close proximity to one another or by joining the inlets together with a common inlet manifold or plenum, mixing of the regenerator effluent gases is promoted and, although this does not reduce the total heat release caused by CO combustion, it will reduce the maximum local temperature rise in the region of the cyclones so that increased operating flexibility is obtained. In addition, $NO_x$ emissions may be reduced by operating the regenerator with a lower amount of excess oxygen and with lower amounts of CO oxidation promoter. Significant reductions in $NO_x$ emissions may be obtained by employing an elongated common primary cyclone inlet duct which not only mixes gases from various parts of the regenerator to promote complete combustion of carbon monoxide with residual oxygen from other parts of the bed, but also entrains sufficient catalyst to absorb the heat released by the CO oxidation which occurs, thereby preventing excessive temperature rises in the region of the cyclones.

According to the present invention, therefore, there is provided a process for regenerating a fluid catalystic by cracking catalyst by contacting the spent catalyst in a dense, fluidized bed regeneration zone where the catalyst is contacted with an oxygen-containing regeneration gas to effect oxidative removal of the coke deposited on the catalyst to produce regeneration effluent gases comprising oxygen, carbon monoxide and carbon dioxide which are removed from the regeneration zone through a number of cyclone separators which return catalyst separated from the regeneration effluent gases to the dense bed of catalyst. The cyclone separators receive regeneration gases from different portions of the regenerator vessel in a common collection region, to mix the regeneration gases from the different parts of the vessel so that combustion of carbon monoxide in the regeneration gases takes place before the gases enter the cyclone separators.

The regeneration apparatus according to the present invention comprises a regeneration vessel with an inlet for spent catalyst from the FCC reactor, an outlet for regenerated catalyst to return to the FCC cracking zone, a gas inlet for injecting oxygen-containing regeneration gas into a dense fluidized bed of catalyst maintained in the regeneration vessel to regenerate the catalyst and cyclone separators for separating entrained catalyst from the regeneration effluent gases and returning the separated catalyst to the dense bed in the regenerator. The cyclones have inlets which are disposed to collect regeneration effluent gases from the entire volume of the regenerator (or substantially the entire volume) in a common collection region so that mixing of the regeneration effluent gases from different points in the regeneration vessel takes place prior to the regeneration gases entering the cyclone separators. In one version of the apparatus, the cyclone separators are located with their inlets located sufficiently close to one another so that they receive the gases from various parts of the regenerator vessel in the region around these adjacent inlets. Alternatively, the cyclone inlets may be joined in a common manifold or plenum so that mixing of the regeneration effluent gases necessarily takes place before the effluent gases enter the cyclones. With this type of arrangement, an elongated cyclone inlet duct may be used to promote entrainment of catalyst from the dilute phase above the dense bed so as to provide a heat sink for the CO oxidation reactions which take place.

THE DRAWINGS

In the accompanying drawings

Figure 4A:
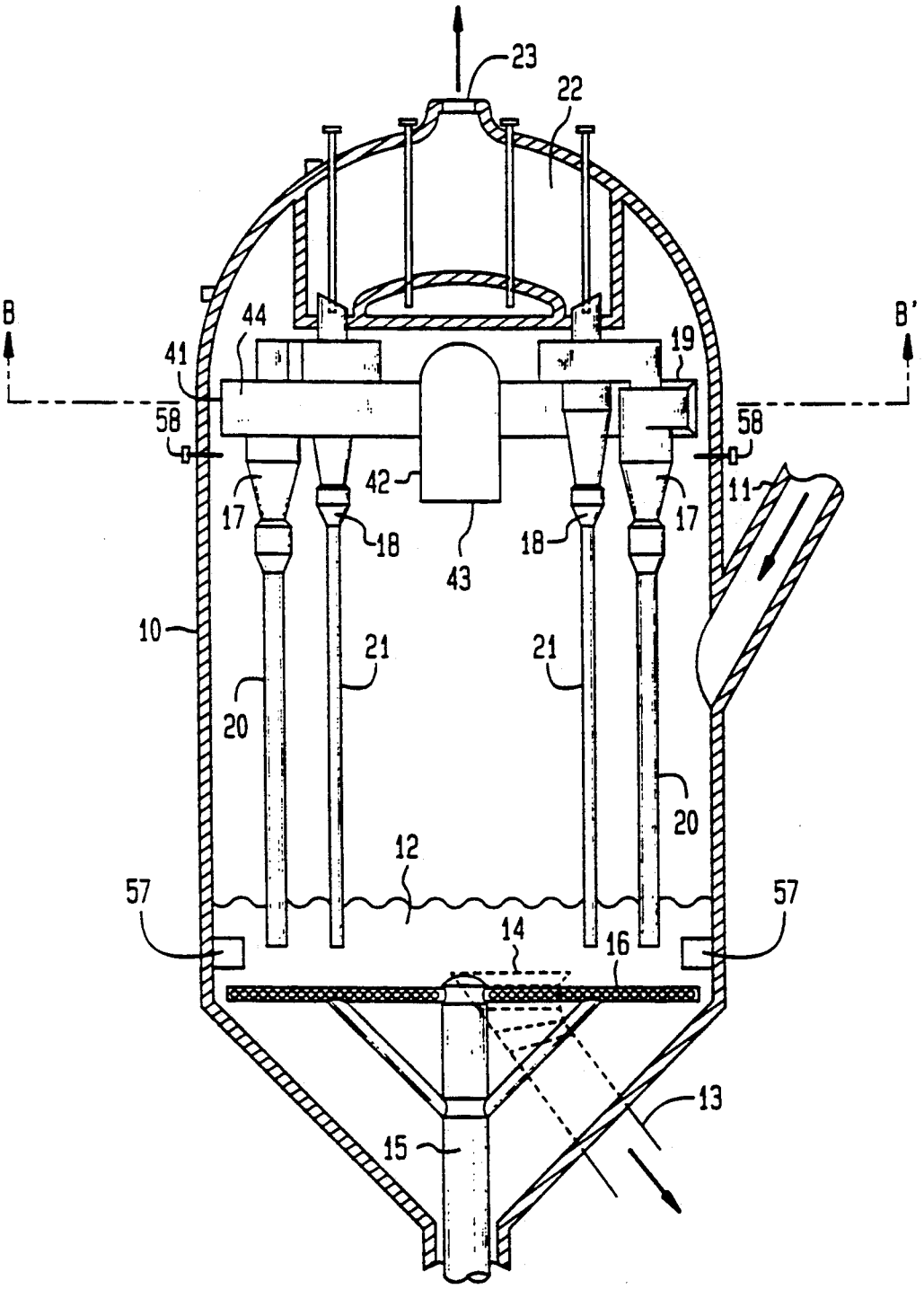
FIG. 4A is a vertical cross-section of an FCC regenerator with the cyclone inlets connected to a common plenum.
Figure 4B:
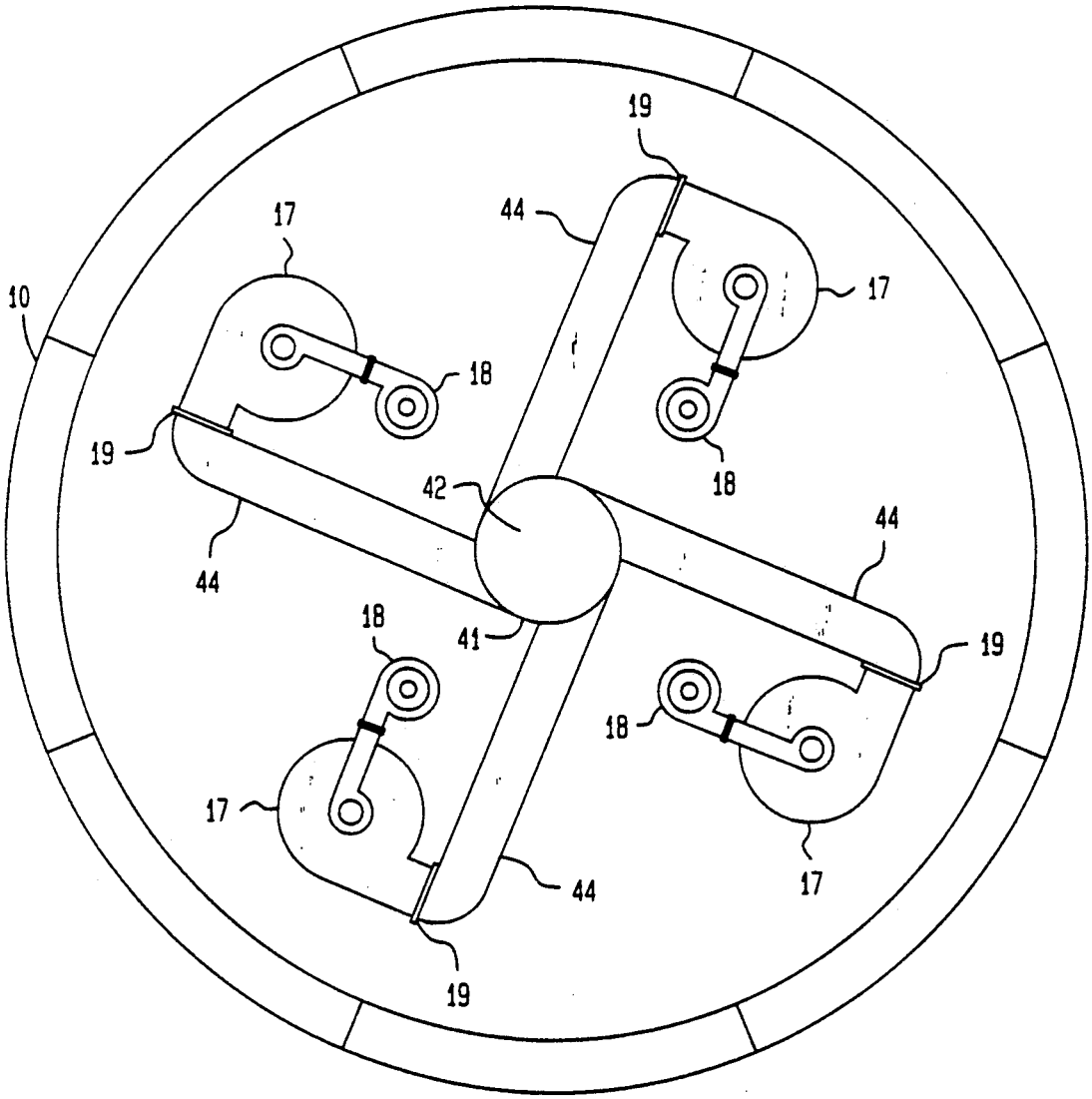
FIG. 4B is a section in simplified form of FIG. 4A along B—B'.
Figure 5A:
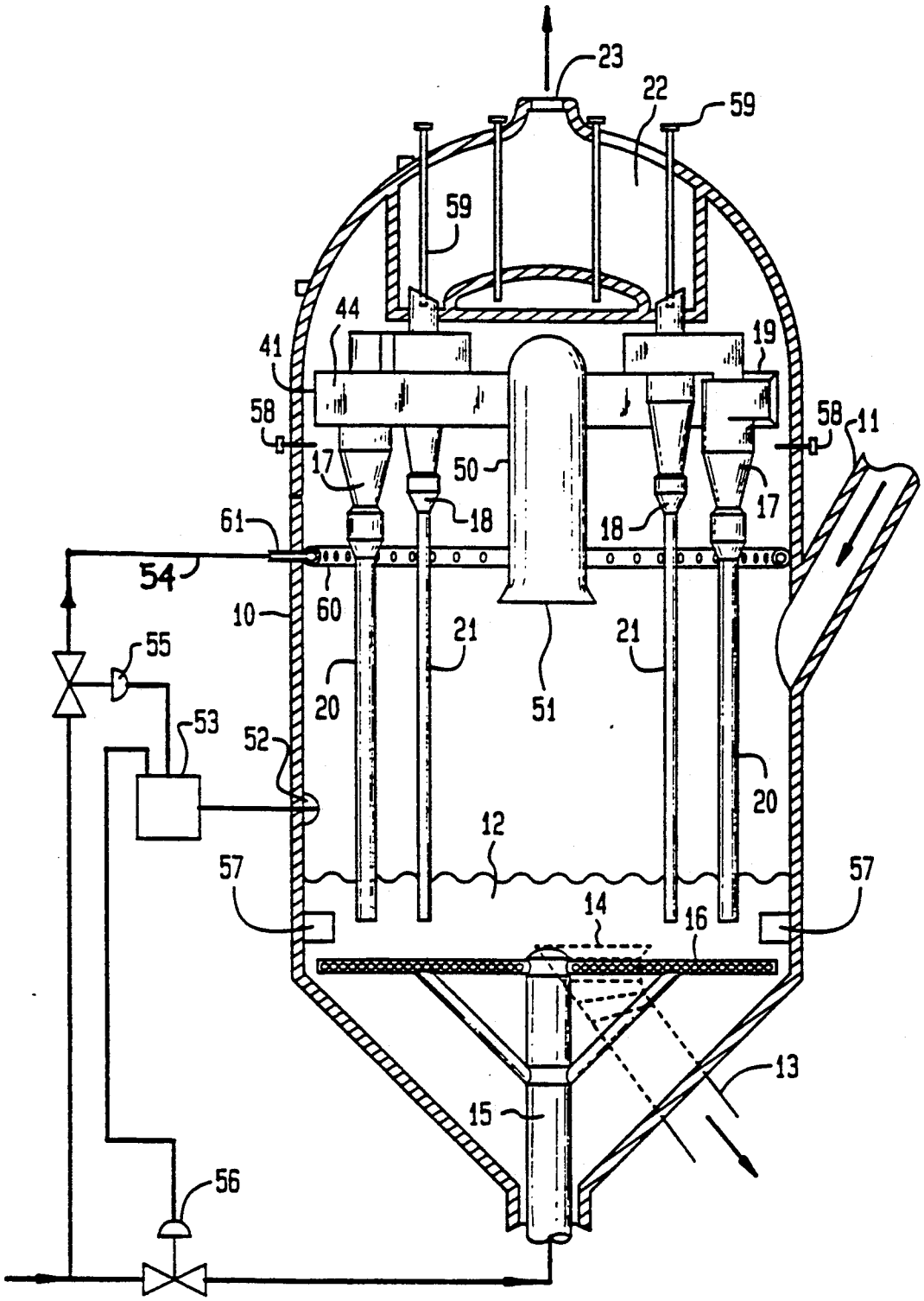
Figure 5B:
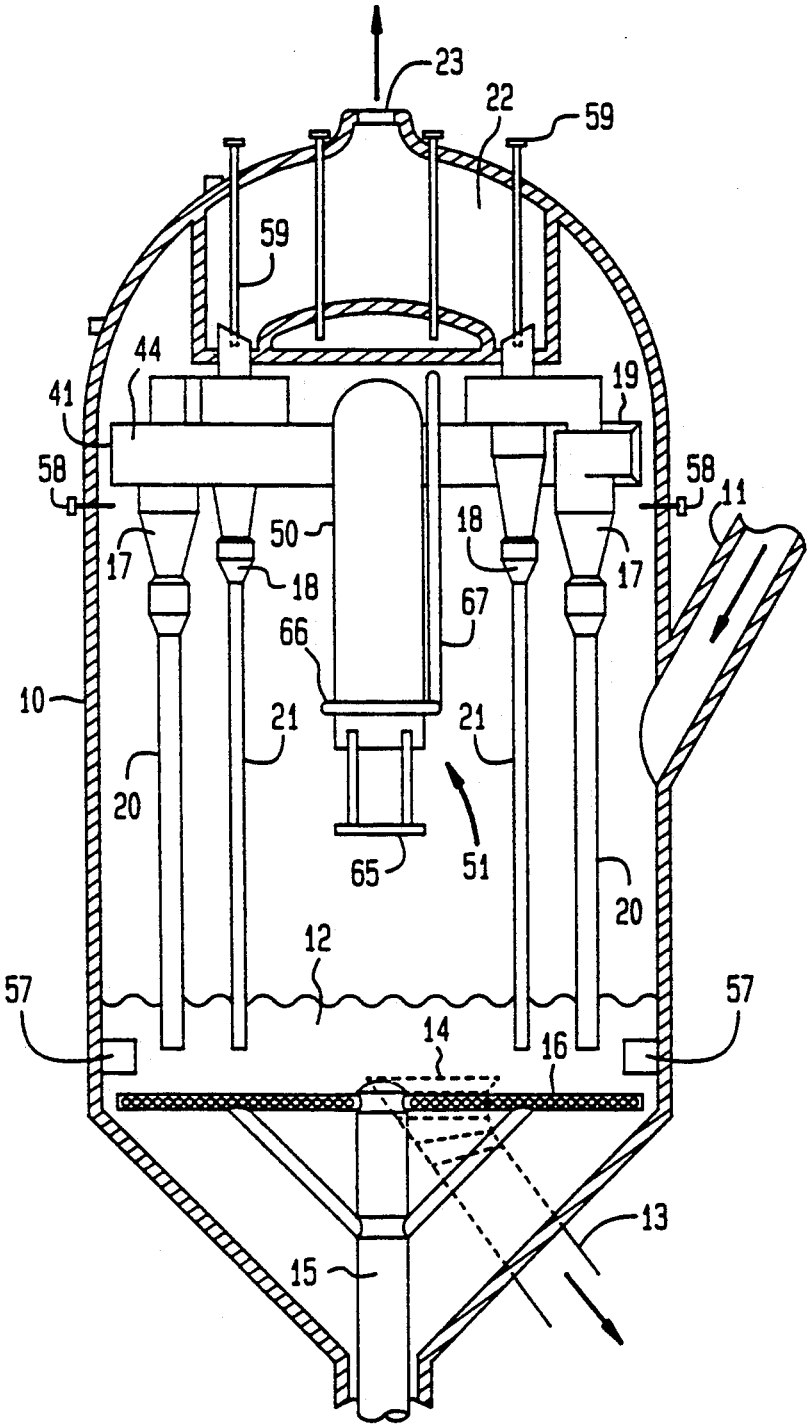

FIG. AC is a horizontal cross section of an FCC regenerator with a modified form of the cyclone arrangement shown in FIGS. 4A and 4B, FIG. 5 is a vertical cross-section of an FCC regenerator with the cyclone inlets connected though a manifold to a common inlet duct, and FIG. 5B shows a modification of FIG. 5A.

DETAILED DESCRIPTION

Figure 1:
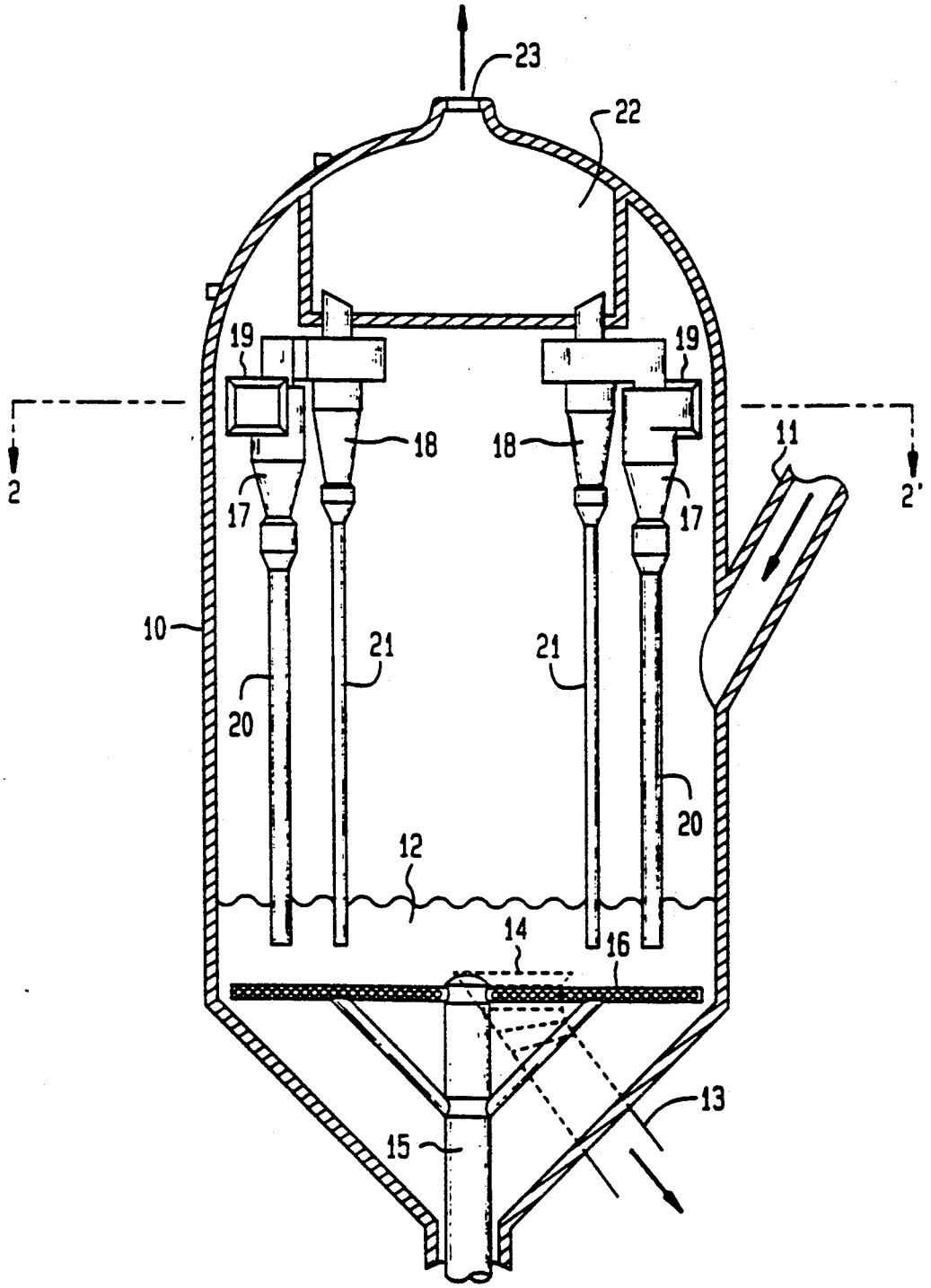
FIG. 1 (PRIOR ART)
FIG. 1 is a vertical cross-section through a conventional dense bed FCC regenerator.

FIG. 1 shows a conventional high inventory, dense bed regenerator which comprises a regenerator vessel 10 with a tangential spent catalyst inlet 11 which receives spent catalyst from the FCC reactor. The spent, coked catalyst enters regenerator vessel 10 through inlet 11 tangentially and imparts a swirling motion to the dense bed 12 of catalyst in the lower portion of the regenerator vessel. Hot, regenerated catalyst is withdrawn from the regenerator through outlet 13 the top of which is situated below the top of dense bed 12. As mentioned above, outlet orifice 14 is disposed radially around the vertical axis of the regenerator vessel in order to provide a sufficient average residence time for the catalyst particles during the regeneration process so that a sufficient degree of regeneration (coke removal) is achieved. An oxygen-containing regeneration gas, usually air, is injected into the regenerator vessel through air inlet 15 and the injected air is distributed across the regenerator vessel by a distributor grid 16 which is connected to the air inlet 15. Distributor 16 may take various forms including those of a perforated, mushroom-like head, of perforated radial distribution arms or of any other appropriate distribution device which is considered to provide good, even distribution of the air throughout the dense bed of catalyst maintained in the regenerator vessel.

Regeneration of the catalyst takes place in dense bed 12 as the regeneration gas passes through the dense bed to carry out the characteristic regeneration processes including conversion of coke on the spent catalyst to carbon monoxide and carbon dioxide and conversion of carbon monoxide to carbon dioxide. The regeneration effluent gases include excess oxygen, carbon monoxide and carbon dioxide together with nitrogen from the original air, various gases released from contaminants present in the coke deposited on the spent catalyst, especially sulphur oxides ($SO_x$), and gases produced by other reactions in the regenerator, especially nitrogen oxides ($NO_x$). A certain proportion of the catalyst is entrained with the regeneration effluent gases as they rise from the dense bed into the region above it, to form a dilute phase of catalyst particles entrained in the regeneration effluent gases. The effluent gases are vented from the regenerator vessel through primary cyclones 17 and secondary cyclones 18. The effluent gases together with entrained catalyst particles enter the inlet horns 19 of primary cyclones 17 and a preliminary separation takes place in the primary cyclones. Catalyst particles separated from the effluent gases are returned to the dense bed from the primary cyclones through diplegs 20 and the effluent gases pass into secondary cyclones 18 where a further separation occurs. Catalyst particles separated from the effluent gases in the secondary cyclones reenter the dense bed through secondary cyclone diplegs 21. After being separated from the catalyst particles in secondary cyclones 18, the regeneration effluent gases enter an effluent plenum 22 and ultimately are discharged to the atmosphere through stack 23.

Figure 2:
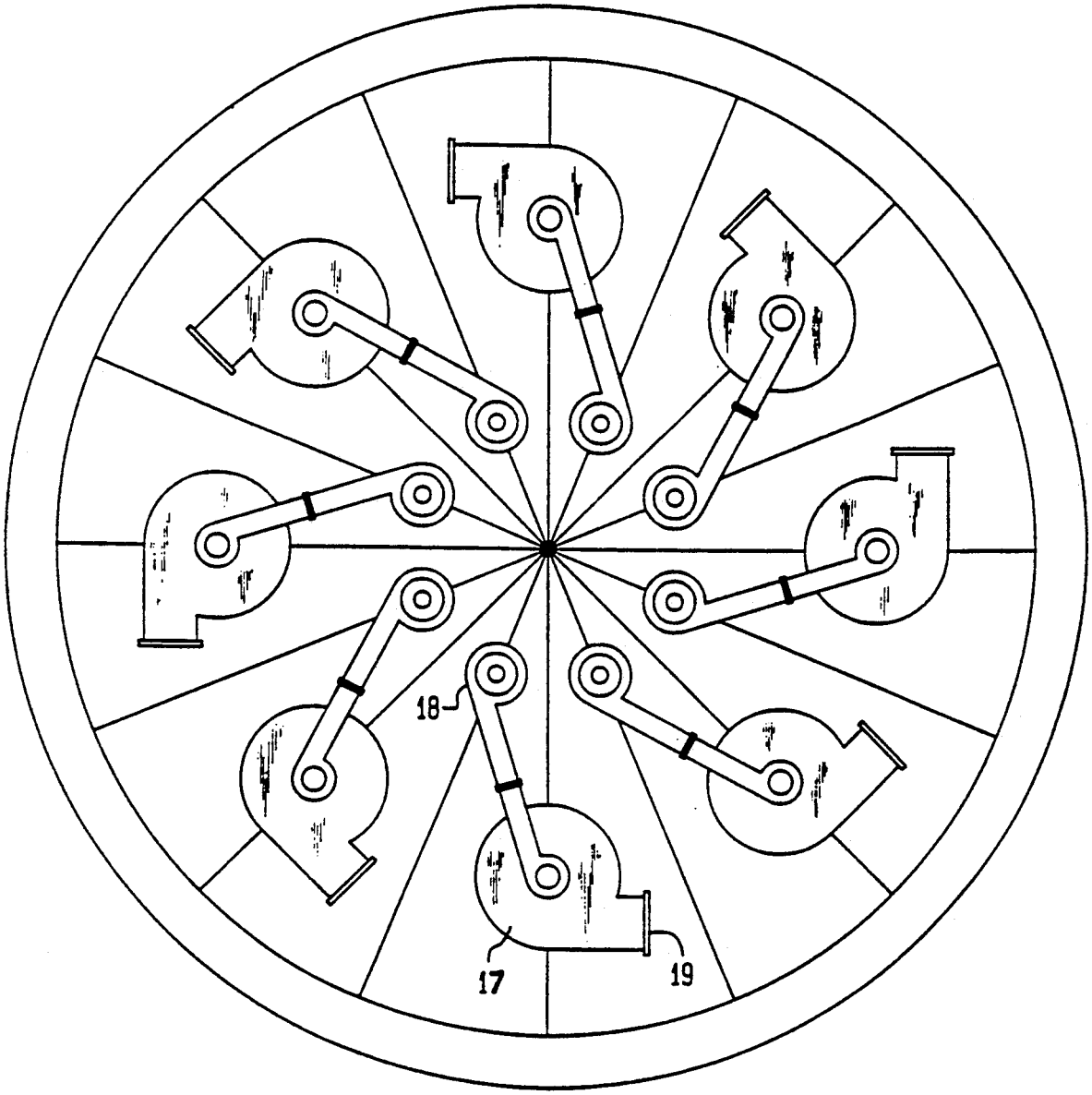
FIG. 2 (PRIOR ART)
FIG. 2 is a horizontal cross-section through the regenerator of FIG. 1 at 2—2'.

The cyclones are conventionally arranged in the manner shown in FIG. 2, with the primary cyclones arranged at a common radius from the central, vertical axis of the regenerator vessel and the secondary cyclones 18 closer to the central axis, again at common radii from the axis. The inlet horns 19 of primary cyclones 17 are disposed towards the periphery of the vessel to receive the regeneration effluent gases.

As discussed above, large FCC dense bed regenerators of this type frequently exhibit poor air/catalyst contacting efficiency. This may result from a number of factors, including bubble formation in the dense bed or uneven carbon distribution in the dense bed because of imperfect solids mixing. Bubble formation is particularly troublesome because when a bubble of regeneration air forms, it passes through the dense bed readily and bypasses the catalyst so that not only is the regeneration of the spent catalyst impaired but, in addition, a bubble of air with a relatively high proportion of oxygen will move upwards through the dilute phase towards the cyclones. This region of excess oxygen is liable to promote rapid combustion of carbon monoxide from other regions of the bed and this effect is, in fact, exacerbated by the formation of the bubble, since the excess of oxygen which is present in the bubble in the dilute phase implies that incomplete conversion of carbon monoxide to carbon dioxide will have occurred elsewhere in the dense phase. Thus, the presence of an oxygen-enriched bubble implies that excess carbon monoxide will be present elsewhere in the dilute phase. Poor air/catalyst contacting efficiency leads to the same result. The presence of free oxygen and carbon monoxide in the dilute phase means that CO combustion may occur high up in the dilute phase or possibly in one of the sets of cyclones with the potential for damage to the affected set. If the CO burning above the dense phase is limited to one set of cyclones the operation of the regenerator and therefore of the entire FCCU may need to be curtailed in order to maintain the affected set within metallurgical temperature constraints even if all other cyclones and regenerator components are at temperatures well below acceptable limits.

Figure 3:
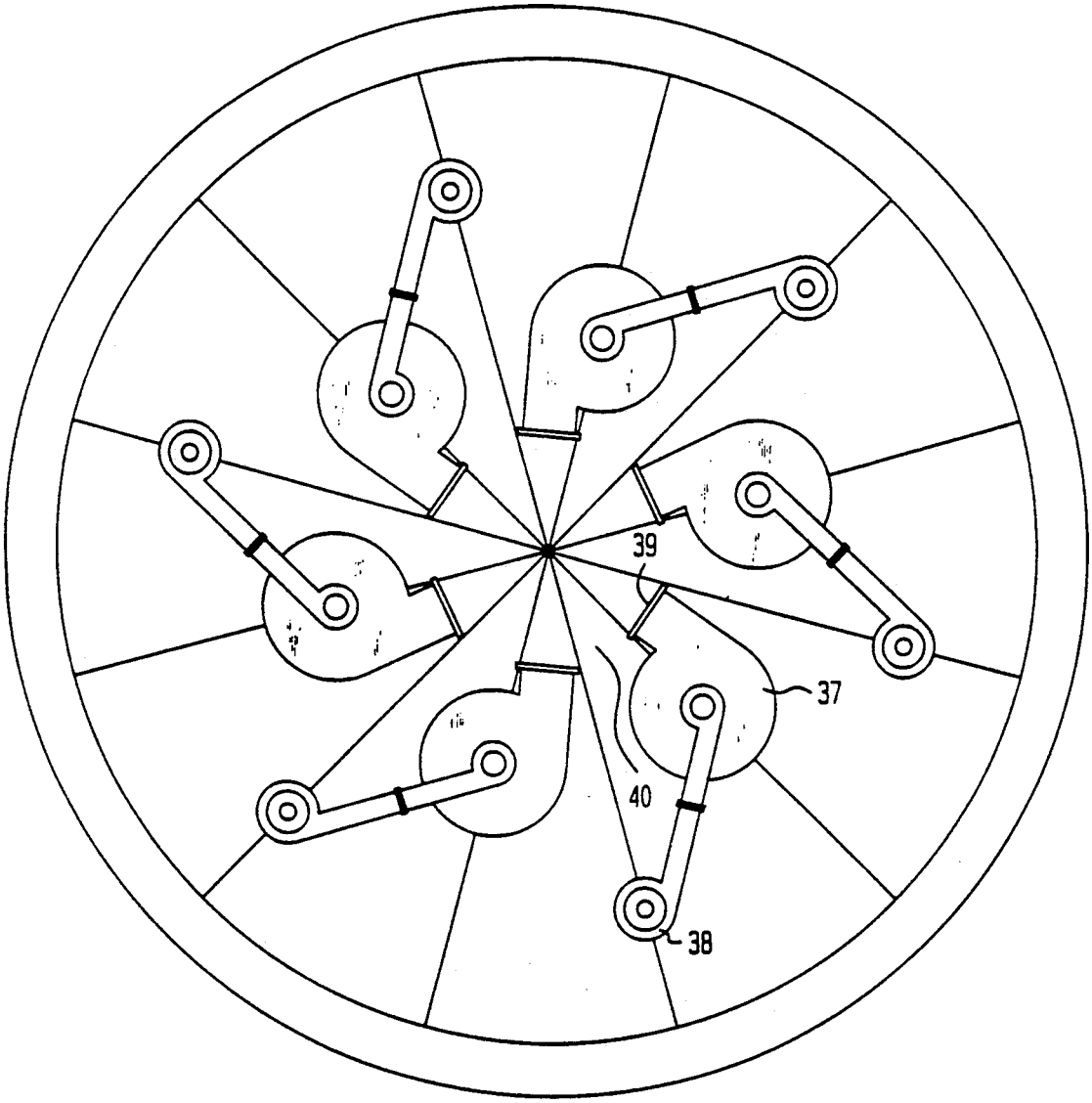
FIG. 3 is a cross-section through dense bed FCC regenerator with the cyclone inlets arranged for collection of the regeneration effluent gases at a common collection region.

FIG. 3 shows a cyclone arrangement which may be used to promote mixing of the regeneration effluent gases prior to entry into the cyclones so as to ensure that any pockets of carbon monoxide and oxygen become well mixed before the gases enter the cyclones. If, therefore, any bubbles of gas containing excessive amounts of oxygen form above the dense bed, either by bubble formation, uneven carbon distribution or any other causes, the excess oxygen will be mixed with the rest of the regeneration effluent gases including any pockets of carbon monoxide, so that CO combustion will be completed before the effluent gases enter the cyclones or take place to an equal extent in all the cyclones, so that no one set of cyclones reaches a temperature significantly above the other sets.

In the arrangement shown in FIG. 3, the primary cyclones 37 are located at a common radius from the central vertical axis of the regenerator vessel, as is conventional and, similarly, the secondary cyclones 38 are also arranged at common radii from the central axis. Only six cyclone sets are shown for clarity but a lesser or greater number could be provided according to the size of the regenerator and other conventional factors. In this arrangement the inlet horns 39 of primary cyclones 37 are arranged adjacent and in close proximity to one another so that they receive effluent gases from a common region 40 between the cyclone inlets. This promotes good mixing of the effluent gases which is completed as the gases reach the common efflux region 40, so that combustion of any excess carbon monoxide is promoted by the contact with the excess oxygen which occurs in the circumstances.

The cyclone inlet horns may be arranged closer together or further apart according to the prevailing gas flow rates, cyclone size and other relevant engineering factors. In the ultimate case, a single primary cyclone with a single inlet will promote mixing of the regeneration gases in the desired manner although the nature of the antecedent situation would be different in the case of a single cyclone because the "hot cyclone" problem would not arise.

The arrangement shown in FIG. 3 promotes mixing of the regeneration effluent gases so as to promote combustion of residual quantities of excess carbon monoxide with any excess oxygen before the effluent gases enter the cyclones. The mixing of the effluent gases from various parts of the vessel can be and preferably is further promoted by the use of a manifold or common plenum which connects the cyclone inlets, as shown in FIGS. 4A and 4B. This arrangement ensures that the effluent gases from different parts of the vessel are mixed prior to entry into the cyclones and is, moreover, easily accommodated within an existing regenerator vessel of the kind shown in FIG. 1 with minimum rearrangement of the cyclones and their associated equipment, such as hanger bars. With the common inlet manifold or plenum, the regeneration effluent gases from different parts of the dilute phase in the regenerator vessel are drawn through a common inlet or inlets and then distributed through a manifold to the cyclone inlets.

The regenerator shown in FIG. 4A is generally similar to that of FIG. 1, both in its construction and manner of operation and, accordingly, identical parts have been given identical reference numerals in both figures. The regenerator shown in FIGS. 4A and 4B employs primary cyclones 17 and secondary cyclones 18 to separate entrained catalyst from the regeneration effluent gases as in the other regenerators, but in the regenerator of FIGS. 4A and 4B the inlets of the primary cyclones 17 are connected to a common manifold or plenum into which the regeneration effluent gases are channelled from the various parts of the regnerator vessel. For clarity, only four cyclones sets are shown in FIG. 4B and only two in 4A, but, clearly, the number of cyclones may be adapted to operational and equipment requirements as appropriate.

The common manifold or plenum 41 has a central hub 42 with a downwardly facing inlet port 43 for receiving the regeneration effluent gases from the regenerator vessel. Upon entering the central hub of the manifold the effluent gases are directed along outwardly extending conduits 44 to cyclone inlets 19 so that the effluent gases and entrained catalyst enter the cyclones for separation, as previously described. In this case, also, the regeneration effluent gases will follow a generally helical path of decreasing diameter from the top of the dense bed to inlet port 43 of the cyclone inlet manifold so that mixing of any excess oxygen and any excess carbon monoxide in the effluent gases is promoted with the result that the CO combustion flame front is kept away from the cyclone inlets. The arrangement shown in FIGS. 4A and 4B is potentially more efficient at mixing than the one shown in FIG. 3 because the effluent gases are required to pass through a single inlet 43 before being divided again to pass to the individual primary cyclones. Thus, intense mixing occurs in manifold hub 42 to promote combustion of residual carbon monoxide. This mixing may be enhanced by the use of mixing vanes or other arrangements. The arms may be disposed radially or tangentially with respect to the manifold hub, as desired, although a tangential arrangement is shown here. Guide vanes for directing the gases into the arms may be provided, if desired. This arrangement also has the advantage that existing cyclone disposition may be employed, e.g. existing cyclone hangar bars, although some cyclones may need to be removed in order to provide space for the manifold arrangement, especially the arms extending outwardly from the central hub of the manifold to the cyclone inlets.

Figure 4C:
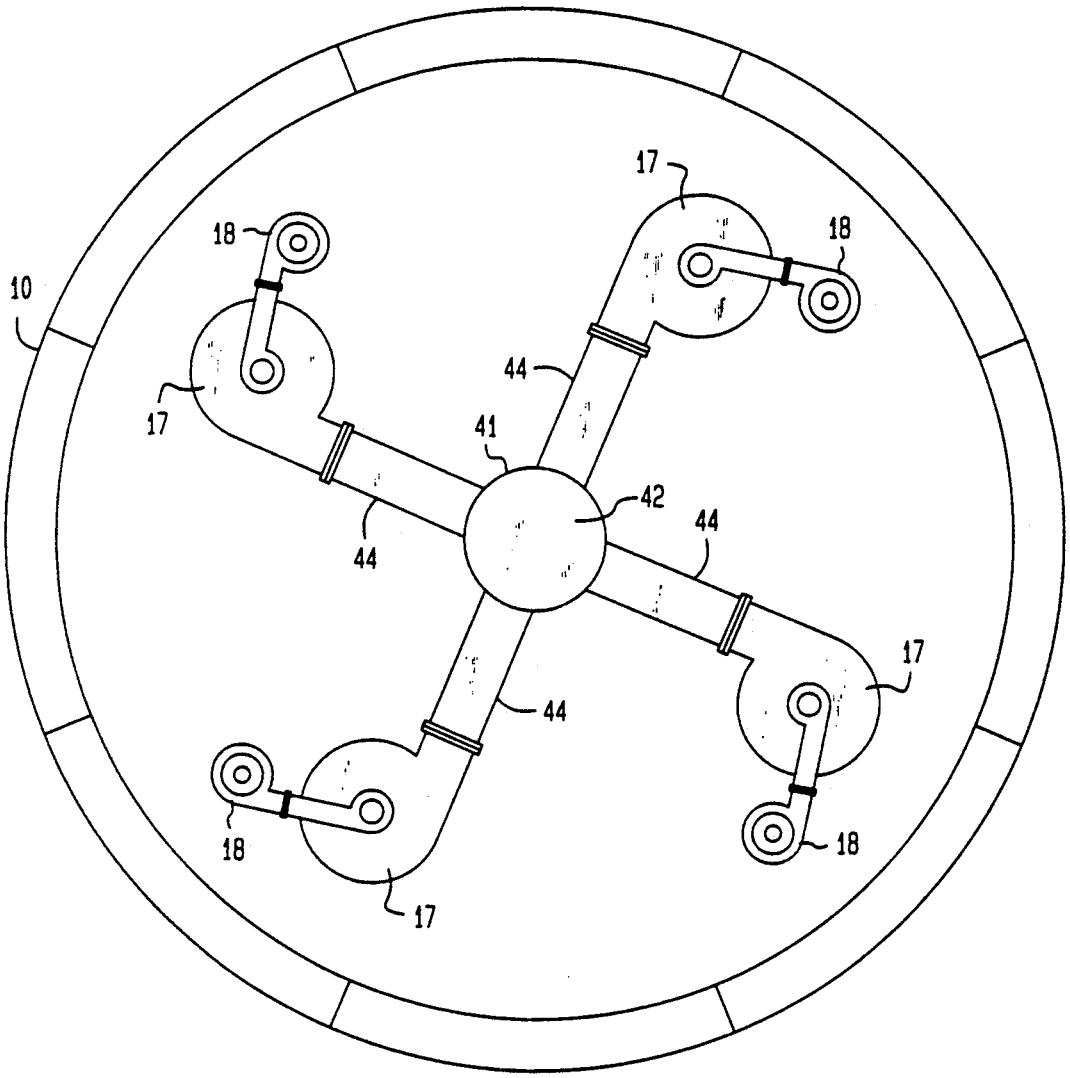

A modified cyclone arrangement is shown in FIG. 4C. This arrangement is similar to that shown in FIG. 4B but the primary cyclones 17 are arranged at the ends of the outwardly—extending flow arms 44 with the cyclone inlets in line with the arms so as to avoid the change of direction at the junction of the arm and the cyclone inlet as in FIG. 4B. The arms in this case are shown as extending radially from the central hub but, as in FIG. 4B, could be arranged tangentially on the hub.

The inlet port to the manifold in FIG. 4 is situated at a relatively high level in the regenerator vessel, so that a significant degree of separation between the entrained catalyst particles and the effluent gases occurs before the effluent gases enter the manifold. This also allows some mixing of the gases in the dilute phase prior to entry into the manifold so that pockets of carbon monoxide are more likely to be burned before the effluent gases enter the manifold. If combustion takes place in the manifold itself, the cyclones will still be substantially protected by the use of the manifold but if the degree of catalyst entrainment can be increased, the catalyst particles will act as an additional heat sink for any combustion which may take place and this will not only increase protection for the cyclones, but also will protect the manifold itself from the effects of localized overheating.

An arrangement for increasing catalyst entrainment is shown in FIG. 5A which is a simplified vertical section of a dense bed FCC regenerator which is generally similar in configuration to the one shown in FIG. 4 with the exception that the cyclone inlet manifold is provided with an elongated common inlet duct which extends down into the dilute phase region of the regenerator vessel, towards the dense bed. The regenerator shown in FIG. 5 has a number of constructional features identical to those shown in FIG. 4 and, accordingly, identical parts have been given identical reference numerals. The regenerator will also operate in the same way as described for the regenerator of FIG. 4 with the differences set out below.

In the regenerator of FIG. 5A the central hub of the cyclone inlet manifold is extended downwardly from the level of the cyclone inlets towards the dense bed of catalyst in the regenerator vessel beneath. The elongated duct 50 is vertical (or substantially so) and is closed at its upper end, forming the top of the manifold hub. The duct is provided with an inlet port 51 at its lower end which faces downwards towards the dense bed of catalyst. The elongated cyclone inlet duct mixes gases from various parts of the regenerator vessel to promote combustion of residual quantities of carbon monoxide with residual oxygen from other parts of the bed. At the same time, the duct extends sufficiently down through the dilute phase that sufficient catalyst is entrained to absorb the heat released by this combustion in the confined gas flow stream passing up the duct, thus preventing excessive temperatures, either in the manifold or in the cyclones themselves. This allows for operation at lower oxygen concentrations for improved efficiency or permits lower levels of CO combustion promoter to be used for reduced $NO_x$ emissions as a consequence of reduced afterburning. Excess oxygen may be reduced to previously unattainable low levels, typically to below 0.5 vol. percent or less, to reduce $NO_x$ emissions by a significant factor.

The inlet rate for the combustion air admitted to the air distributor below the dense bed can be adjusted to the stoichiometric air/coke ratio so that reducing conditions are maintained in the dense bed. Under these conditions, formation of nitrogen oxides is disfavored and if any nitrogen oxides are formed, they are reduced to nitrogen or other reduced, gaseous nitrogen species. If any air bypassing occurs in the dense bed, secondary combustion of the uncombusted CO which results will take place in the elongated, vertical duct to the cyclone inlet manifold. Secondary air for this combustion may be introduced into the dilute phase or at the inlet to the elongated duct. In this way, staged combustion may be achieved, allowing further reductions in the $NO_x$ level of the effluent gases by maintaining a reducing atmosphere in the dense bed and completing combustion in the elonged duct. This staged combustion operation differs from the process described in U.S. Pat. No. 4,309,309 where additional fuel is injected into the lower part of the dense bed in order to maintain a reducing atmosphere, with air being injected into the upper part of the bed to complete combustion. The injection of fuel is, of course, wasteful in normal continuous operation and it is a significant advantage of the present regenerator that it permits staged combustion to take place without the addition of extra fuel, i.e. with the coke on the catalyst as the sole fuel and source of heat in the dense bed. Thus, in the present regeneration, the desired reducing conditions are maintained by control of the oxygen/coke ratio in the dense bed.

The use of the duct resembles in certain respects the riser employed in the regenerator of U.S. Pat. No. 3,926,778, where heat of CO combustion taking place in the vertical transfer line or riser is transferred to the catalyst particles in the riser so that the catalyst is not only effectively heated to a higher temperature, but also acts as a heat sink, protecting the equipment. Thus, some of the advantages characteristic of the riser type combustion regenerator may be secured in existing dense bed units with the additional potential for carrying out staged combustion by injection of secondary combustion air above the dense bed or at the inlet to the elongated duct.

Control of the oxygen concentrations in the dense bed and the dilute phase may be effected in response to measurements of the oxygen concentration at various points in the regenerator. In FIG. 5A, the regenerator employs an oxygen sensor 52 which is linked to an oxygen flow rate controller 53 for controlling the air inlet rates through inlet 15 and upper air inlet 54 by means of controlling valves 55 and 56. By maintaining the reducing atmosphere in the dense bed (by suitable control of air inlet rate as indicated by oxygen sensor 52) the resulting CO-rich atmosphere in the dense bed and the region immediately above it reduces $NO_x$ species to reduced, gaseous compounds of nitrogen, i.e. $N_2$, $NH_3$ and other gaseous N compounds which are either innocuous or can be readily removed from the regenerator effluent gases by conventional techniques.

Secondary combustion to complete the combustion of the carbon monoxide is accomplished in the elongated, common inlet duct to the cyclone inlet manifold. The distance from the inlet of the duct to the top of the dense bed is determined to achieve a desired degree of catalyst entrainment so that catalyst enters and passes up the duct or semi-riser and absorbs the heat produced by the combustion of the carbon monoxide in the duct. This will also increase the temperature of the dense bed since the heated catalyst is returned to the dense bed by means of the cyclones. This, in turn, promotes good combustion in the dense bed so that low levels of coke on the regenerated catalyst are achieved.

Secondary air for the combustion of the carbon monoxide may be introduced to the dilute phase at a level above the dense bed. As shown in FIG. 5A, the secondary air may be introduced through an apertured air injection ring 60 which encircles the upper portion of the regenerator vessel, with air injection apertures on its inner surface. Air is supplied to ring 60 through secondary air inlet 61. Alternatively an injection ring may be disposed around the inlet to the duct so that the injected secondary air mixes with the regeneration gases as they enter the duct. Although a number of secondary air inlets may be disposed around the periphery of the regenerator either in a ring as shown or by separate, spaced inlets, a highly uniform air distribution may not be necessary as the injected secondary air will travel down through the dilute phase to the entrance of the inlet duct and, in doing so, will mix thoroughly with the gases leaving the dense bed under the turbulent, high velocity conditions prevailing at the entrance to the inlet duct and within the duct itself. Injection of the secondary air around the periphery of the vessel will tend to promote combustion in the dilute phase outside of the duct (which is not undesirable) and injection of the secondary air in the region of the duct inlet will tend to promote combustion in the duct. Control of the regeneration operation may be enhanced by the use of temperature sensors at appropriate points in the regenerator in addition to the use of the oxygen sensor/controller. For example, temperature sensors 57 may be provided in the dense bed, sensors 58 in the dilute phase near the cyclones and, finally, cyclone temperature sensors 59 at the outlet of the secondary cyclones.

FIG. 5B shows a modification of FIG. 5A (with certain components omitted for clarity). A baffle 65 is disposed below the bottom of common inlet duct 50 in order to prevent the duct drawing up gas and catalyst from just below the bottom of the duct, especially when the top of the dense bed approaches the bottom of the duct. In addition, the baffle may help to eliminate cyclone operating instabilities resulting from bubbles bursting immediately below the duct inlet.

The secondary air is provided by means of an air injection ring 66 around the duct inlet, supplied by air inlet 67. Alternatively, the secondary air may be supplied by a ring as shown in FIG. 5A or by separate inlets or by air injection higher in the vessel, for instance, above the manifold 44. As an alternative to the open-ended duct with the baffle suspended beneath it, a closed-end duct with side inlets may be provided.

We claim:

1. In a fluid catalytic cracking unit having a cracking zone including a reactor vessel and a regeneration zone including a catalyst regenerator wherein the improvement comprises:

(i) a regeneration vessel comprising a vessel having a side inlet connected to the reactor for admitting spent cracking catalyst from the reactor to a single dense, fluidized bed of catalyst in which regeneration of the catalyst takes place, (ii) an outlet for regenerated catalyst at the bottom of the regeneration vessel for withdrawing regenerated catalyst from the dense, fluidized bed of catalyst, (iii) a gas inlet for injecting oxygen-containing regeneration gas into the dense, fluidized bed of catalyst maintained in the lower portion of the regeneration vessel to regenerate the catalyst, (iv) a plurality of cyclone separators inside the regeneration vessel for separating entrained catalyst from regeneration effluent gases and returning the separated catalyst to the dense bed in the regenerator, the cyclone separators having inlets above the spent catalyst inlet, disposed to collect regeneration effluent gases from the regeneration vessel at a common collection region so that mixing of the regeneration effluent gases from different points in the regeneration vessel takes place prior to the regeneration gases entering the cyclone separators, (v) a cyclone separator inlet manifold having a central hub with at least one inlet at the common collection region, and (vi) outwardly-extending conduits extending from the central hub to the inlets of the cyclone separators connecting the hub to the cyclone inlets.

2. A regenerator according to claim 1 which includes:

(vii) an elongated, vertical inlet duct extending downwardly in the regenerator vessel from the central hub of the cyclone separator inlet manifold towards the region of the dense bed of catalyst, the duct having an inlet at its lower end for receiving regeneration effluent gases and entrained catalyst particles from the region above the dense bed.

3. A regenerator according to claim 2 in which the duct has an open end forming the inlet and a baffle below the inlet.

4. A fluid catalystic cracking unit having a cracking zone including a reactor vessel and a regeneration zone including a catalyst regenerator which comprises:

(i) a regeneration vessel with (ii) an inlet at the side of the vessel connected to the reactor for admitting spent catalyst to a single dense, fluidized bed of catalyst in which regeneration of the catalyst takes place, (iii) an outlet for regenerated catalyst at the bottom of the regeneration vessel for withdrawing regenerated catalyst from the dense, fluidized bed of catalyst, (iv) a regeneration gas inlet for injecting oxygen-containing regeneration gas into a dense, fluidized bed of catalyst maintained in the lower portion of the regeneration vessel to regenerate the catalyst, (v) separator means comprising a plurality of cyclone separators having their inlets above the level of the spent catalyst inlet, disposed to collect regeneration effluent gases from the regeneration vessel at a common collection region so that mixing of the regeneration effluent gases from different points in the regeneration vessel takes place prior to the regeneration gases entering the cyclone separators, (vi) a cyclone separator inlet manifold having a central hub with at least one inlet at the common collection region, (vii) outwardly-extending conduits extending from the central hub to the inlets of the cyclone separators to connect the hub to the cyclone inlets, (viii) an elongated, substantially vertical duct having an open lower end and which is connected at its upper end to the central hub of the inlet manifold, to convey catalyst particles and regeneration effluent gases from the elongated duct to the cyclone separators.

5. A regenerator according to claim 4 in which the cyclone separator inlets are connected to the top of the elongated duct by means of radial conduits extending outwardly from the central hub of the inlet manifold to the cyclone inlets.

6. A regenerator according to claim 4 which includes:

(ix) at least one secondary regeneration gas inlet for injecting additional oxygen-containing regeneration gas into the region of the regeneration vessel above the region of the dense bed.

7. A regenerator according to claim 6 in which the secondary regeneration gas inlet is disposed to inject the secondary regeneration gas in the region of the inlet to the elongated duct.

8. A regenerator according to claim 7 which has a plurality of secondary regeneration gas inlets arranged around the periphery of the regeneration vessel above the region of the dense bed.

* * * * *